US009281608B2

(12) United States Patent
Zhao et al.

(10) Patent No.: US 9,281,608 B2
(45) Date of Patent: Mar. 8, 2016

(54) WATERPROOF ELECTRICAL CONNECTOR

(71) Applicant: HON HAI PRECISION INDUSTRY CO., LTD., New Taipei (TW)

(72) Inventors: Jun Zhao, Kunshan (CN); Jing-Jie Guo, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/247,489

(22) Filed: Apr. 8, 2014

(65) Prior Publication Data

US 2014/0302709 A1 Oct. 9, 2014

(30) Foreign Application Priority Data

Apr. 8, 2013 (CN) ..... 2013 2 01704084 U

(51) Int. Cl.

| | |
|---|---|
| ***H01R 13/52*** | (2006.01) |
| ***H01R 12/57*** | (2011.01) |
| *H01R 12/50* | (2011.01) |
| *H01R 4/70* | (2006.01) |
| *H01R 13/6581* | (2011.01) |

(52) U.S. Cl.

CPC ..... *H01R 13/5202* (2013.01); *H01R 12/57* (2013.01); *H01R 4/70* (2013.01); *H01R 13/5213* (2013.01); *H01R 13/6581* (2013.01); *H01R 23/7073* (2013.01)

(58) Field of Classification Search

CPC ..... H01R 13/5216; H01R 13/52; H01R 4/70; H01R 13/5213; H01R 13/5219; H01R 13/5202; H01R 13/521; H01R 23/7073

USPC ..... 439/519, 521, 271, 587, 607.32

See application file for complete search history.

(56) References Cited

U.S. PATENT DOCUMENTS

| | | | | |
|---|---|---|---|---|
| 8,808,035 | B2 * | 8/2014 | Wu et al. | 439/668 |
| 2013/0183845 | A1 * | 7/2013 | Tan | H01R 13/5202 439/271 |
| 2014/0273628 | A1 * | 9/2014 | De Chazal | 439/607.32 |

FOREIGN PATENT DOCUMENTS

| | | |
|---|---|---|
| CN | 102957035 | 3/2013 |
| TW | M327579 | 2/2008 |
| TW | M419287 | 12/2011 |

* cited by examiner

*Primary Examiner* — Abdullah Riyami
*Assistant Examiner* — Justin Kratt
(74) *Attorney, Agent, or Firm* — Ming Chieh Chang; Wei Te Chung

(57) ABSTRACT

An electrical connector (100) has a front insertion opening and a receiving space (40) for receiving a mating connector. The electrical connector includes an insulative housing (2), a number of contacts (3) retained in the insulative housing, a metal shield (4) covering the insulative housing, an insulative cover (5) assembling outside of the metal shield, and a waterproof block (7) interposed between the metal shield and the insulative cover along a vertical direction. The waterproof block is formed by cooling and solidifying glue material from a rear of the metal shield and insulative cover combination. A bulge (532) is formed at one of the insulative cover and the metal shield. The bulge extends along a transverse direction perpendicular to a mating direction along which the mating connector is inserted. The bulge seamlessly seals between the metal shield and the insulative cover.

20 Claims, 5 Drawing Sheets

WATERPROOF ELECTRICAL CONNECTOR

BACKGROUND OF THE INVENTION

Field of the Invention

The present invention relates generally to an electrical connector, and more particularly to an electrical connector assembled on an electronic appliance and preventing water from entering into the interior of the electronic appliance.

A waterproof electrical connector usually has a sealing material or block portion formed at a rear portion opposite to an insertion opening thereof for preventing water from entering into interior of the electronic appliance via the insertion opening through the rear portion. The block portion is formed by filling glue into gaps between an insulative housing and a metal shield. However, glue material may enter into the mating receiving space of the electrical connector and obstruct the insertion of the mating connector.

An electrical connector preventing water from entering into the interior of the electronic appliance is desired.

SUMMARY OF THE INVENTION

Accordingly, an object of the present invention is to provide an electrical connector preventing water from entering into interior of an electronic appliance.

To achieve the above object, an electrical connector has a front insertion opening and a receiving space for receiving a mating connector. The electrical connector includes an insulative housing, a number of contacts retained in the insulative housing, a metal shield covering the insulative housing, an insulative cover assembling outside of the metal shield, and a waterproof block interposed between the metal shield and the insulative cover along a vertical direction. The waterproof block is formed by cooling and solidifying glue material from a rear of the metal shield and insulative cover combination. A bulge is formed at one of the insulative cover and the metal shield. The bulge extends along a transverse direction perpendicular to a mating direction along which the mating connector is inserted. The bulge seamlessly seals between the metal shield and the insulative cover.

Other objects, advantages and novel features of the invention will become more apparent from the following detailed description when taken in conjunction with the accompanying drawings.

DETAILED DESCRIPTION OF THE PREFERRED EMBODIMENT

Figure 1:
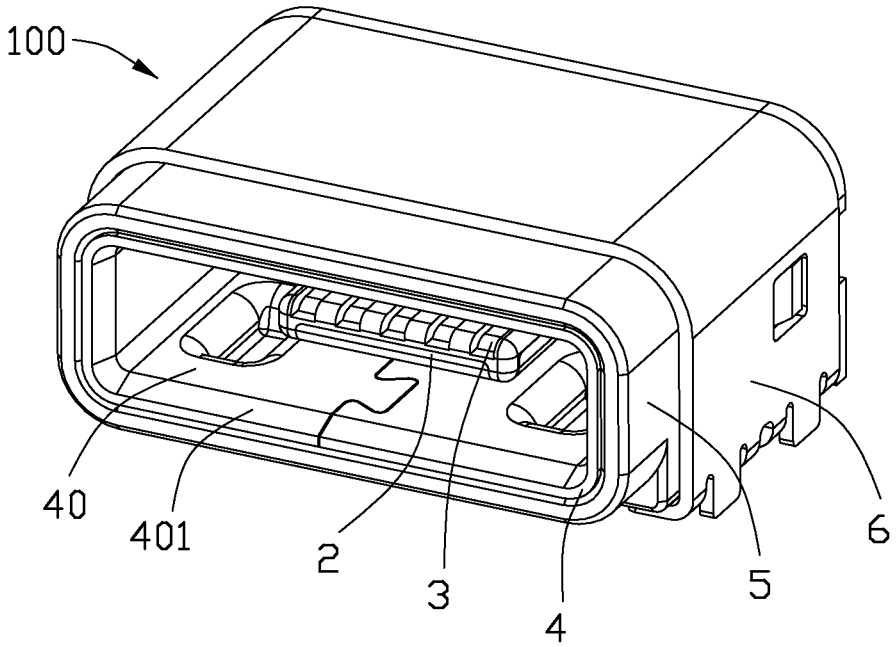
FIG. 1 is a perspective, assembled view of a USB receptacle connector constructed in accordance with the present invention.

Reference will now be made in detail to the preferred embodiment of the present invention.

Referring to FIGS. 1-5, a USB receptacle connector 100 of the present invention comprises an insulative housing 2, a plurality of contacts 3 retained in the insulative housing 2, a metal shield 4 covering the insulative housing 2 for defining a receiving space 40 therebetween, an insulative cover 5 partly covering the metal shield 4, a metal cover 6 assembled on the insulative cover 5, and a waterproof block 7 attached to a rear face of the insulative housing 2. The receiving space 40 has an insertion opening 401 for receiving a mating plug connector (not shown).

Figure 3:
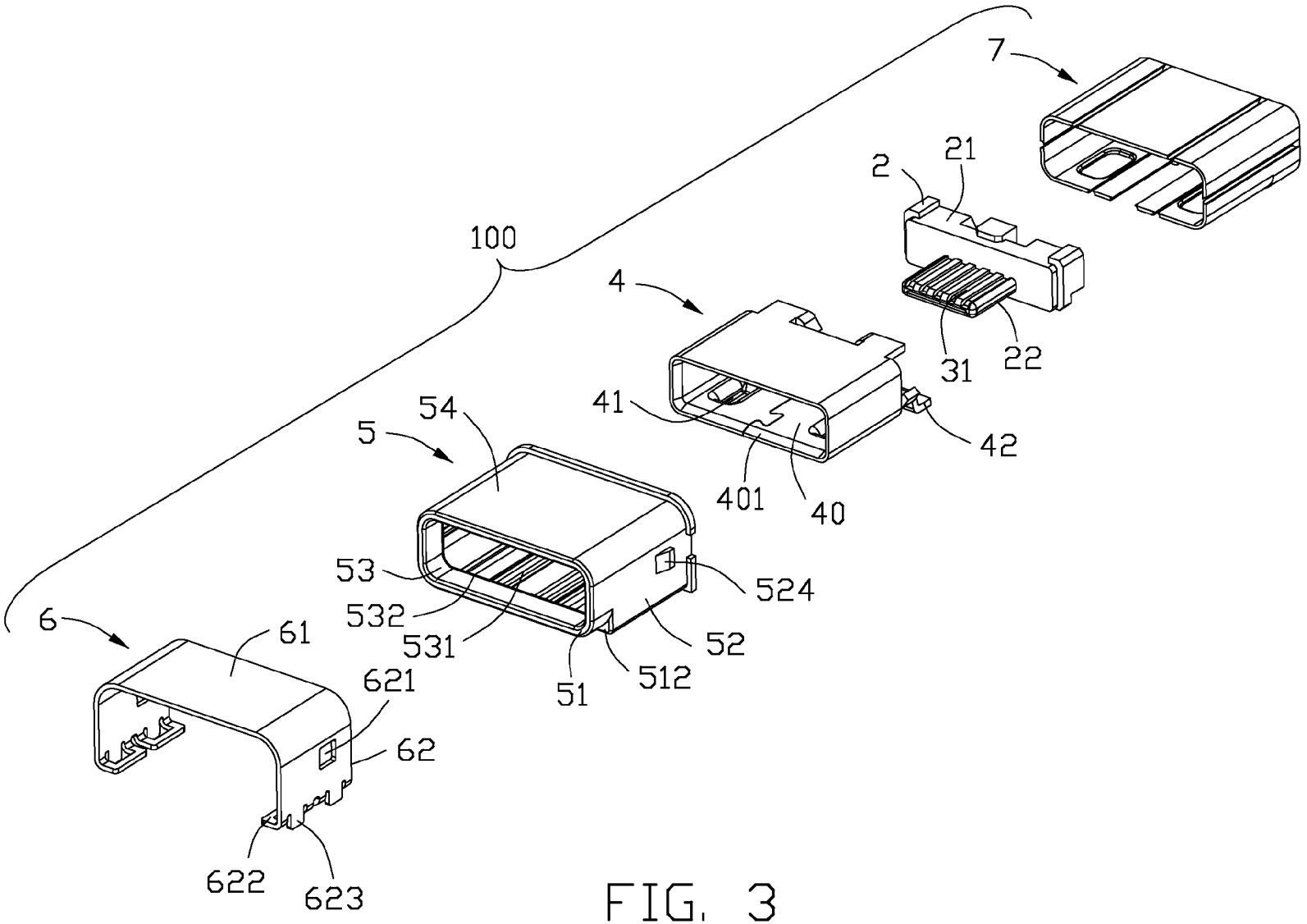
FIG. 3 is a perspective, exploded view of the USB receptacle connector.
Figure 4:
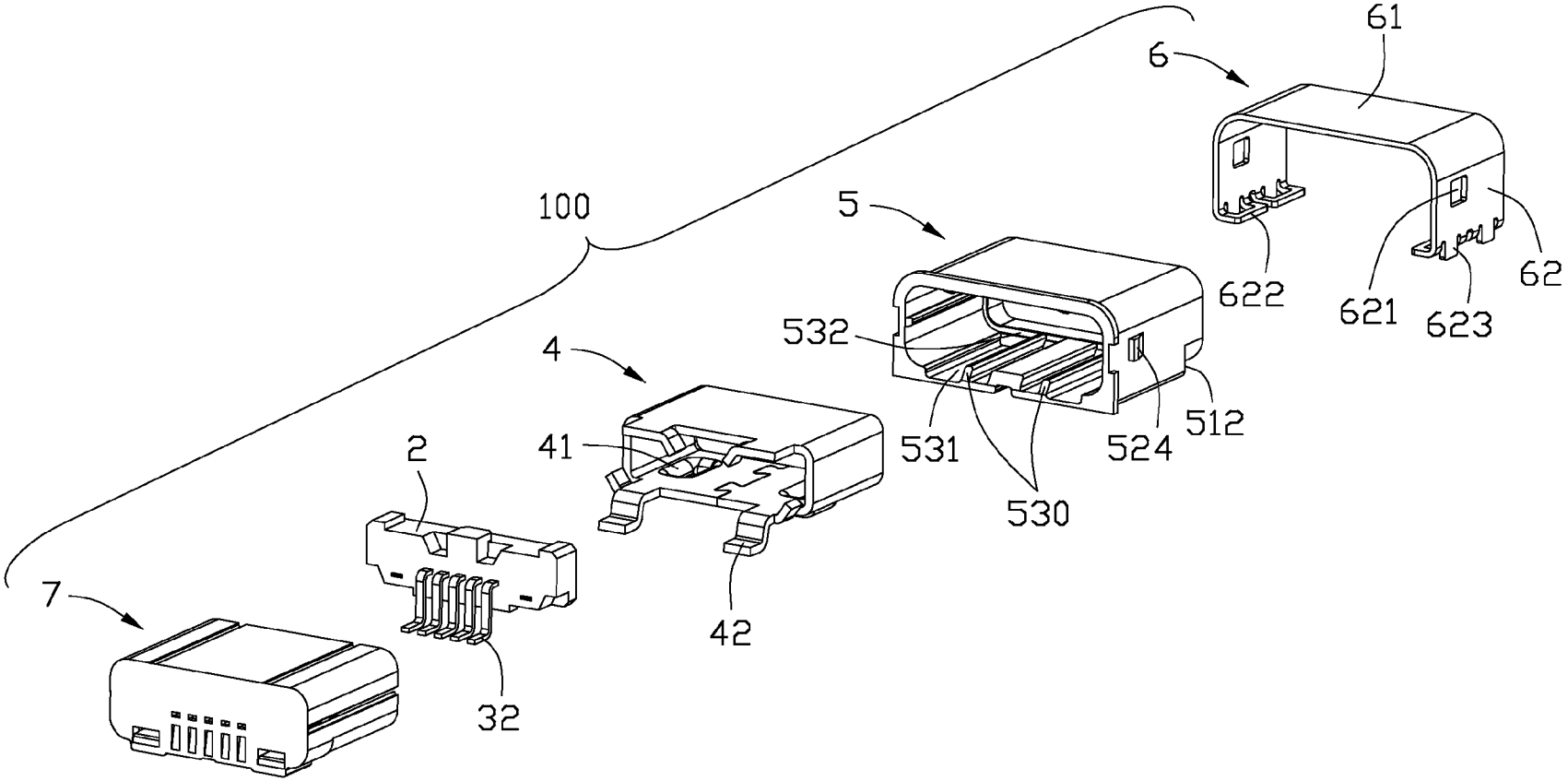
FIG. 4 is similar to FIG. 3 but taken from a different aspect.
Figure 5:
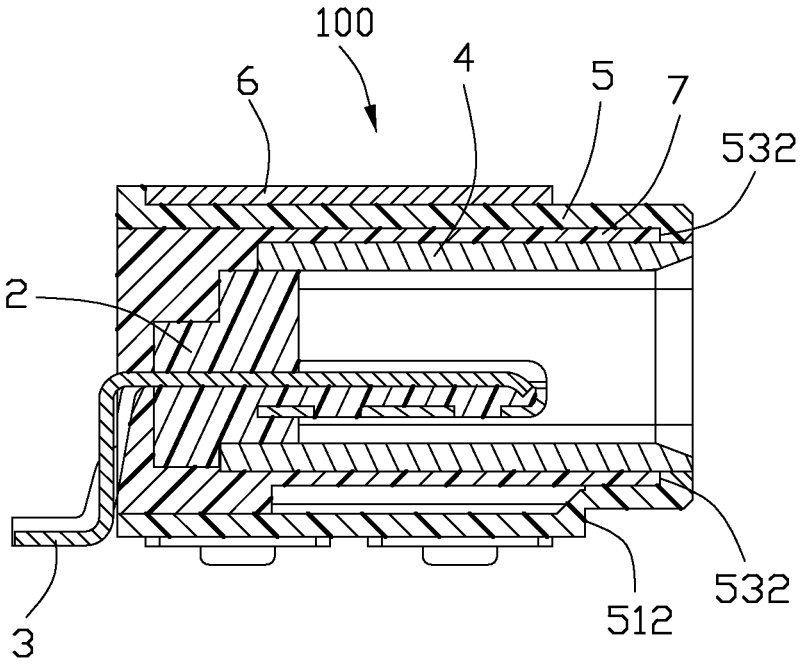
FIG. 5 is a cross-sectional view taken along line 5-5 of FIG. 2.

Referring to FIGS. 3 and 4, the insulative housing 2 has a base portion 21 and a tongue portion 22 extending forwardly from the base portion 21. The contacts 3 have a plurality of contacting portions 31 extending beyond the base portion 21 for connecting with the mating plug connector and a plurality of soldering portions 32 extending out of the insulative housing 2 for soldering on a printed circuit board (not shown).

Referring to FIGS. 3 and 4, the metal shield 4 is stamped from a metal piece and then assembled on the insulative housing 2. The metal shield 4 has a plurality of prominences 41 protruding outwardly to leave spaces between the prominences 41 and the insulative housing 2. The metal shield 4 has a pair of legs 42 extending rearwardly and then downwardly for soldering on the printed circuit board.

Referring to FIGS. 3 and 4, the insulative cover 5 is frame shaped. The insulative cover 5 comprises a front portion 51 defining the insertion opening 401 and a rear portion 52 behind the insertion opening 401. The insulative cover 5 has an inner face 53 facing towards the receiving space 40 and an outer face 54 opposite to the inner face 53. A stepped portion 512 is formed on the outer face 54 and between the front portion 51 and the rear portion 52. A pair of securing portions 524 is formed on the outer face 54 of the rear portion 52. A plurality of lengthwise ribs 530 is formed on the inner face 53 of the rear portion 52 along the mating direction and a transverse bulge 532 is formed on the inner face 53 of the front portion 51 along a transverse direction perpendicular to the mating direction for interference between the insulative cover 5 and the metal shield 4. A plurality of slots 531 extending along a mating direction is formed on the inner face 53. In the preferred embodiment, the bulge 532 is positioned between the stepped portion 512 and the insertion opening 401 along the mating direction. The insulative cover 5 is pre-molded and then assembled on the metal shield 4 for waterproof purpose. The prominences 41 are received in the slots 531 for guiding the assembling process of the insulative cover 5 on the metal shield 4.

Figure 2:
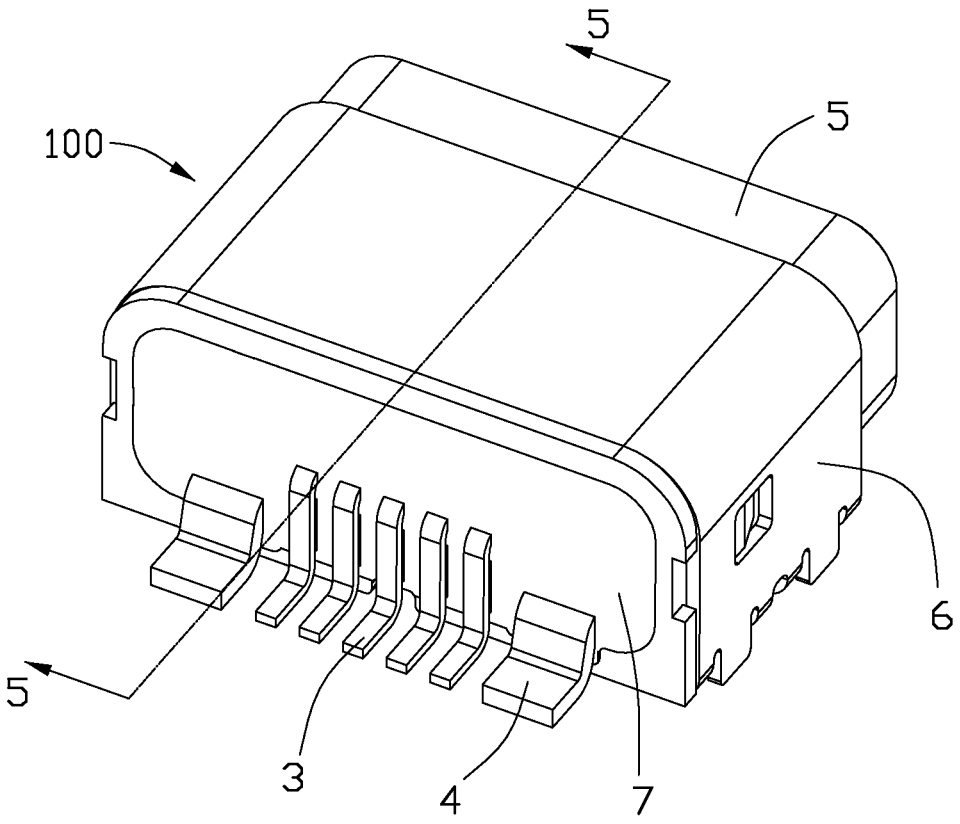
FIG. 2 is similar to FIG. 1 but taken from a different aspect.

Referring to FIGS. 2-4, the metal cover 6 comprises a main portion 61 and a pair of lateral portions 62 bending vertically from two lateral edges of the main portion 61. The main portion 61 and the lateral portions 62 are attached to the outer face 54 of the insulative cover 5. The lateral portions 62 define a pair of cutouts 621 and the cutouts 621 receive the securing portions 524 for securing the metal cover 6 on the insulative cover 5. In other embodiment, the cutouts 621 are alternatively defined on the insulative cover 5 and the securing portions 524 are correspondingly formed on the metal cover 6. Each lateral portion 62 has a pair of soldering pads 622 bending inwardly for soldering on the printed circuit board. Each soldering pad 622 is split from center thereof to form a vertically extending board lock 623. Generally speaking, four soldering pads 622 and four board locks 623 are formed on the metal cover 6 for both soldering and securing with the printed circuit board.

Referring to FIGS. 2-4, the waterproof block 7 is formed between the metal shield 4 and the insulative cover 5 along a vertical direction by filling, cooling, and then solidifying glue. The waterproof block 7 wholly covers the base portion 21 of the insulative housing 2 and partly covers the metal shield 4. The waterproof block 7 extends forwardly to terminate at the bulge 532. The soldering portions 32 of the contacts 3 and the soldering legs 42 of the metal shield 4 both extend out of the waterproof block 7 for soldering on the printed circuit board.

The bulge 532 of the insulative cover 5 prevents glue from reaching the insertion opening of the USB receptacle connector 100 during filling glue in the gap between the metal cover 4 and the insulative cover 5. In the present, preferred embodiment, the bulge 532 is formed at the inner face 53 of the insulative cover 5. Certainly, the bulge 532 can be alternatively formed at an outer surface of the metal shield 4. Namely, the bulge 532 is formed at one of the insulative cover 5 or the metal shield 4 and seamlessly seals between the metal shield 4 and the insulative cover 5. Therefore, the bulge 532 prevents glue from flowing into the receiving space 40 via the insertion opening of the mating plug connector. The USB receptacle connector 100 permanents that the mating plug connector is successfully inserted into the electrical connector 100. The USB receptacle connector 100 has a perfect waterproof effect.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector having a front insertion opening and a receiving space for receiving a mating connector, comprising:

an insulative housing;

a plurality of contacts retained in the insulative housing;

a metal shield covering the insulative housing; an insulative cover assembling outside of the metal shield; and a waterproof block interposed between the metal shield and the insulative cover by cooling and solidifying glue material applied from a rear of the metal shield and insulative cover combination;

wherein a bulge is formed at one of the insulative cover or the metal shield and extends along a transverse direction perpendicular to a mating direction along which the mating connector is inserted, and the bulge seamlessly seals between the metal shield and the insulative cover.

2. The electrical connector as claimed in claim 1, wherein the waterproof block extends forwardly to terminate at the bulge.

3. The electrical connector as claimed in claim 1, wherein the insulative cover has a front portion, a rear portion, and on an outer face thereof a stepped portion between the front portion and the rear portion.

4. The electrical connector as claimed in claim 3, wherein the bulge is positioned between the stepped portion and an insertion opening along the mating direction.

5. The electrical connector as claimed in claim 1, wherein the waterproof block is sandwiched between the insulative cover and a part of the insulative housing which is exposed outside of the metal shield.

6. The electrical connector as claimed in claim 5, wherein the waterproof block surrounds a rear part of the insulative housing.

7. The electrical connector as claimed in claim 1, wherein the contact has a contacting portion extending rearwardly outside of the waterproof block.

8. The electrical connector as claimed in claim 1, further comprising a metal cover covering the insulative cover, and wherein the metal cover is soldered to a printed circuit board and locked with the printed circuit board.

9. The electrical connector as claimed in claim 8, wherein four soldering pads and four board locks are formed on the metal cover for soldering to and securing with the printed circuit board, and each board lock is split from the corresponding soldering pad.

10. The electrical connector as claimed in claim 1, wherein the bulge is formed at an inner face of the insulative cover.

11. The electrical connector as claimed in claim 1, wherein the bulge is formed at an outer surface of the metal shield.

12. The electrical connector as claimed in claim 1, wherein the insulative cover comprises a plurality of inner ribs extending along the mating direction.

13. An electrical connector comprising:

an insulative housing including a base portion and a tongue portion extending forwardly from the base portion;

a metallic shield assembled to the base portion and enclosing the tongue portion to define a receiving space communicating with an exterior via a front opening;

a frame-like insulative cover enclosing the shield and forming, adjacent to said front opening, a bulge with a rearward step thereof and further forming a plurality of slots behind said bulged section; and a waterproof block derived from a melted glue to fill, via solidification, not only a space behind the housing in the shield but also gaps between the shield and the cover, and be forwardly terminated at the bulge.

14. The electrical connector as claimed in claim 13, wherein the glue invades the slots.

15. The electrical connector as claimed in claim 13, wherein a front end of the shield and that of the cover are terminated essentially at a same position.

16. The electrical connector as claimed in claim 13, wherein said shield forms a plurality of outward prominences to outwardly abut against the cover.

17. An electrical connector comprising:

an insulative housing including a base portion and a tongue portion extending forwardly from the base portion;

a metallic shield assembled to the base portion and enclosing the tongue portion to define a receiving space communicating with an exterior via a front opening;

a frame-like insulative cover enclosing the shield and forming, around an interface between the cover and the shield, a bulged structure formed around the front opening and a plurality of slots behind said bulged section; and a waterproof block derived from a melted glue to fill, via solidification, not only a space behind the housing in the shield but also gaps between the shield and the cover, and be forwardly terminated at the bulge.

18. The electrical connector as claimed in claim 17, wherein the bulged structure is formed by the cover.

19. The electrical connector as claimed in claim 17, wherein said slots are formed by the cover.

20. The electrical connector as claimed in claim 17, wherein said cover includes a plurality of ribs each sandwiched by the block.

* * * * *